US005509746A

United States Patent [19]

Ho

[11] Patent Number: 5,509,746

[45] Date of Patent: Apr. 23, 1996

[54] LOOSE-LEAF PICTURE ALBUM

[76] Inventor: Cheng-Cheng Ho, P.O. Box 1750, Taichung, Taiwan

[21] Appl. No.: 263,740

[22] Filed: Jun. 22, 1994

[51] Int. Cl.[6] ..... F42F 13/00

[52] U.S. Cl. ..... 402/79; 281/38; 281/33; 402/4

[58] Field of Search ..... 281/15.1, 22, 28, 281/38, 51, 31, 33; 402/79, 4

[56] References Cited

U.S. PATENT DOCUMENTS

| | | | |
|---|---|---|---|
| 3,270,449 | 9/1966 | Robbie | 281/33 X |
| 3,502,295 | 3/1970 | Sgonga | 281/33 X |
| 5,393,158 | 2/1995 | Dall'Arancio | 281/38 X |

*Primary Examiner*—Willmon Fridie, Jr.

[57] ABSTRACT

A loose-leaf picture album comprises a bottom plate having an upper end to which a plurality of blank pages are fastened at the top end thereof in such a manner that the blank pages can be easily removed or replaced, An arcuate cross rod is provided at the portion where the blank pages are fastened to the bottom plate. The bottom plate comprises a front piece and a rear piece, which are joined together by two connection pieces such that the front and the rear pieces can be folded and unfolded. Each of the blank pages is provided with the transparent protective membranes forming at both sides of the blank page an entry slot and an exit slot to facilitate the mounting and the removing of a picture. The loose-leaf picture album can be displayed uprightly on a desk top or fastened to a wall by hooks.

1 Claim, 7 Drawing Sheets

LOOSE-LEAF PICTURE ALBUM

FIELD OF THE INVENTION

The present invention relates generally to a loose-leaf picture album, and more particularly to loose-leaf album which can be displayed uprightly on a desk top or fastened to a wall by hooks.

BACKGROUND OF THE INVENTION

A conventional loose-leaf picture album of the prior art comprises a plurality of blank pages for mounting pictures. The pictures can be easily organized in the loose-leaf picture album. However, such prior art loose-leaf picture album is generally limited in that it can not be used to display the pictures uprightly on a desk top, and that it can not be fastened to a wall by hooks.

A conventional desk top picture frame is also limited in that its back plate must be first removed to allow a picture to be put into the picture frame or taken away from the picture frame, and that its production cost is relatively high, and further that it can display only one picture, and still further that it can not be fastened to a wall by hooks.

SUMMARY OF THE INVENTION

It is therefore primary objective of the present invention to provide a loose-leaf picture album which can be used to display pictures uprightly on a desk top.

It is another objective of the present invention to provide a loose-leaf picture album which can be fastened to a wall for displaying the pictures.

It is still another objective of the present invention to provide a loose-leaf picture album with blank pages having a better ventilation and capable of protecting the pictures from humidity.

It is still another objective of the present invention to provide a loose-leaf picture album which can be made at a relatively low cost.

In keeping with the principle of the present invention, the foregoing objectives of the present invention are attained by a loose-leaf picture album, which comprises a bottom plate having an upper end to which a plurality of blank pages are fastened at the top end thereof in such a manner that the blank pages can be easily removed or replaced. An arcuate cross rod is provided at the portion where the blank pages are fastened to the bottom plate. The bottom plate comprises a front piece and a Fear piece, which are joined together by two connection pieces such that the front and the rear pieces can be folded and unfolded. Each of the blank pages is provided with the transparent protective membranes forming at both sides of the blank page an entry slot and an exit slot to facilitate the mounting and the removing of a picture. Each of the blank pages has an appropriate margin on which certain remarks relating to the pictures may be written. The loose-leaf picture album can be displayed uprightly on a desk top or fastened to a wall by hooks.

The foregoing objectives, features and functions of the present invention can be more readily understood upon a thoughtful deliberation of the following detailed description of the present invention in conjunction with the accompanying drawings.

DETAILED DESCRIPTION OF THE INVENTION

Figure 1:
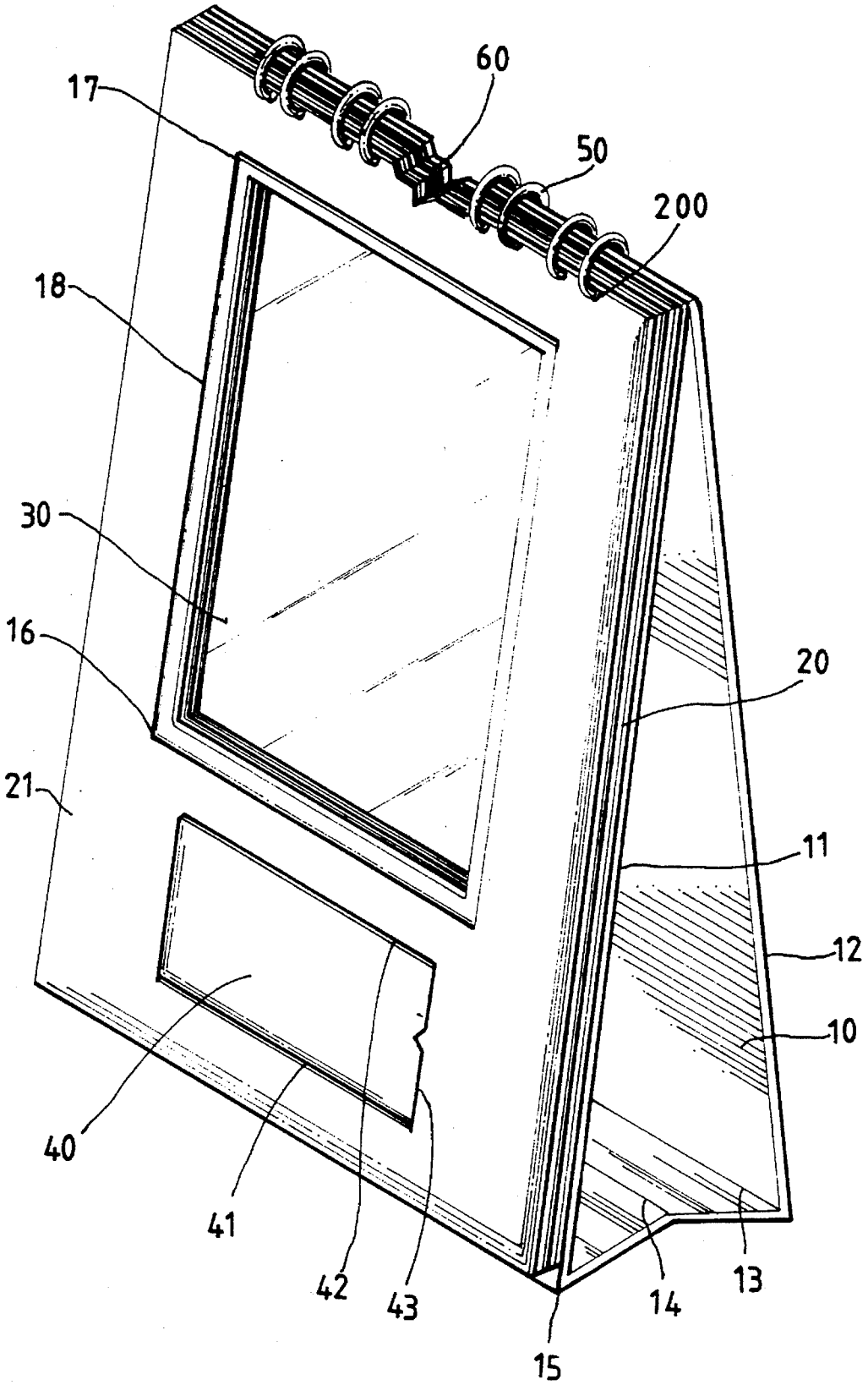
FIGS. 1 and 2 are perspective views of the present invention.
Figure 2:
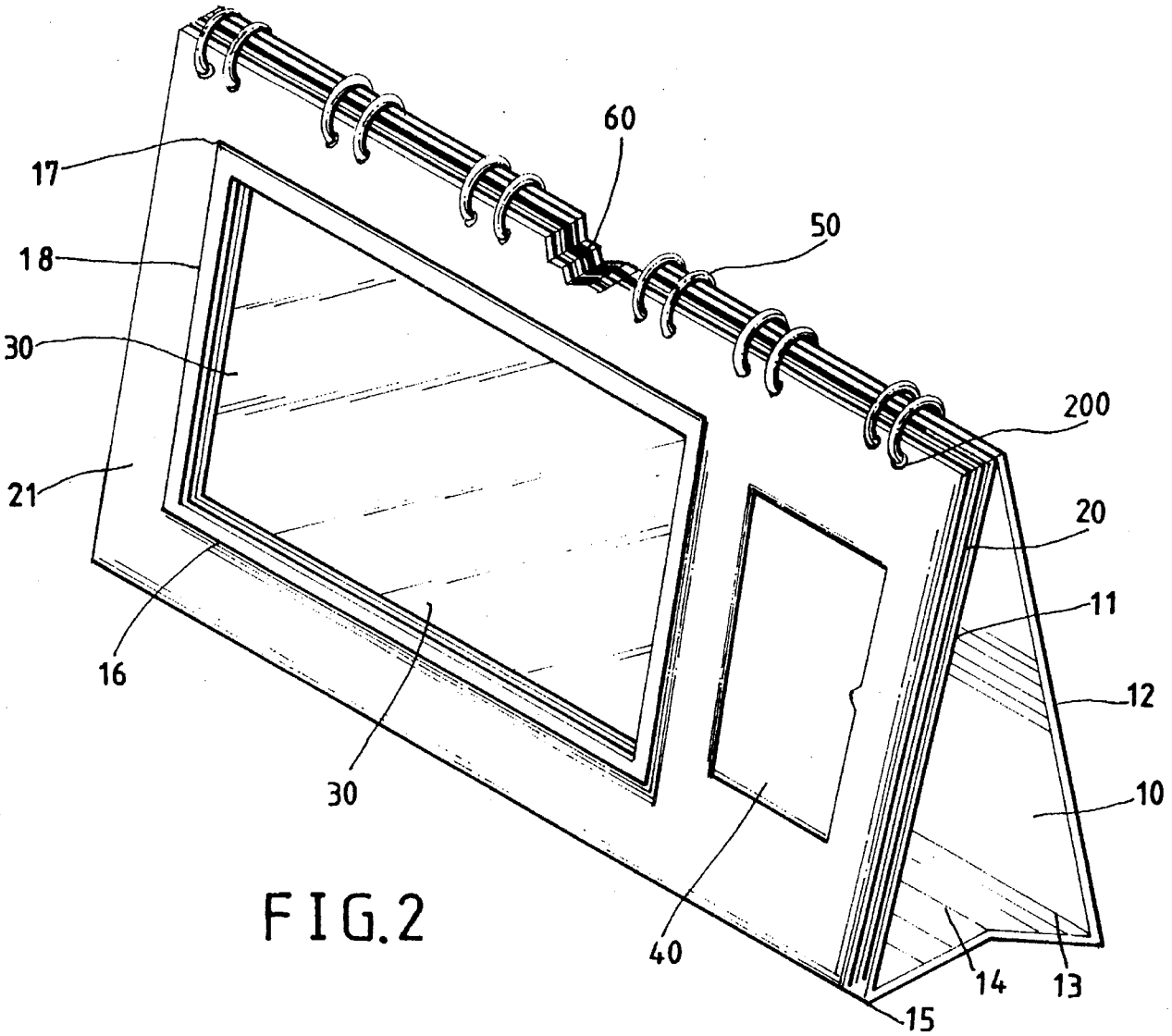
Figure 7:
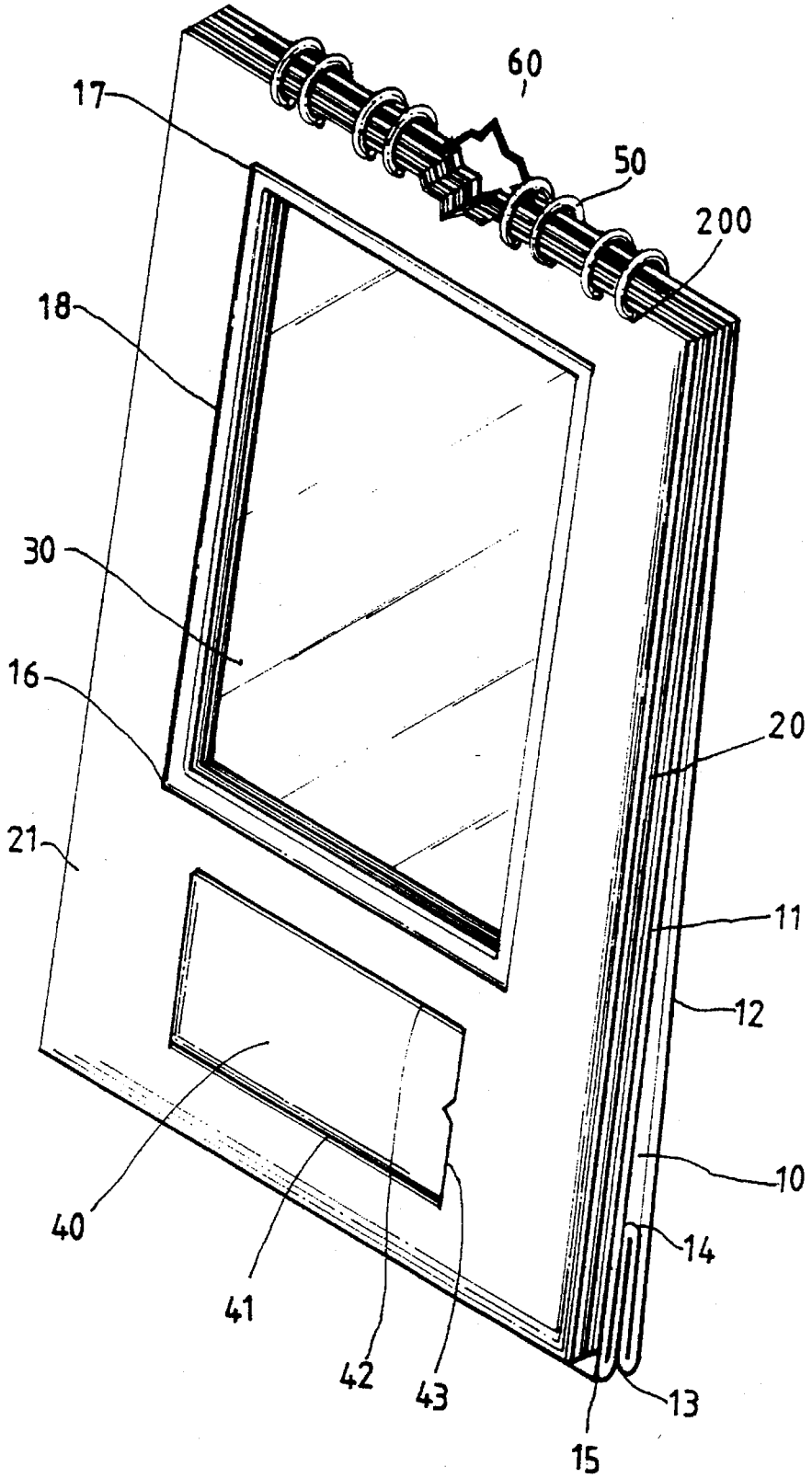
FIG. 7 is a schematic view showing that the loose-leaf picture album of the present invention is folded so as to be fastened to a wall.

As shown in FIG. 1 and 2, the loose-leaf picture album of the present invention comprises a bottom plate 10 provided with a front piece 11, a rear piece 12, and a plurality of creases 13, 14 and 15. The loose-leaf picture album of the present invention can be therefore displayed uprightly on a desk top, as shown in FIG. 1, or fastened to a wall, as shown in FIG. 7. Fastened between the front piece 11 and the rear piece 12 are a plurality of blank pages 20, which can be easily removed or replaced. Each of the blank pages 20 is provided with a ventilation window 30, which has an upper edge 17 and a lower edge 16. A transparent protective membrane 18 is fastened to the lower edge 16 and the upper edge 17 such that a picture can be easily inserted thereinto or removed therefrom from both sides of the window 30.

located under the window 30 is a smaller window provided with a transparent protective membrane 40 which is fastened to an upper edge 42 and a lower edge 41 of the window. An information card can be inserted into the window 40 via a port 43. The information card is used to write thereon various remarks relating to the picture kept in the window 30.

Figure 5:
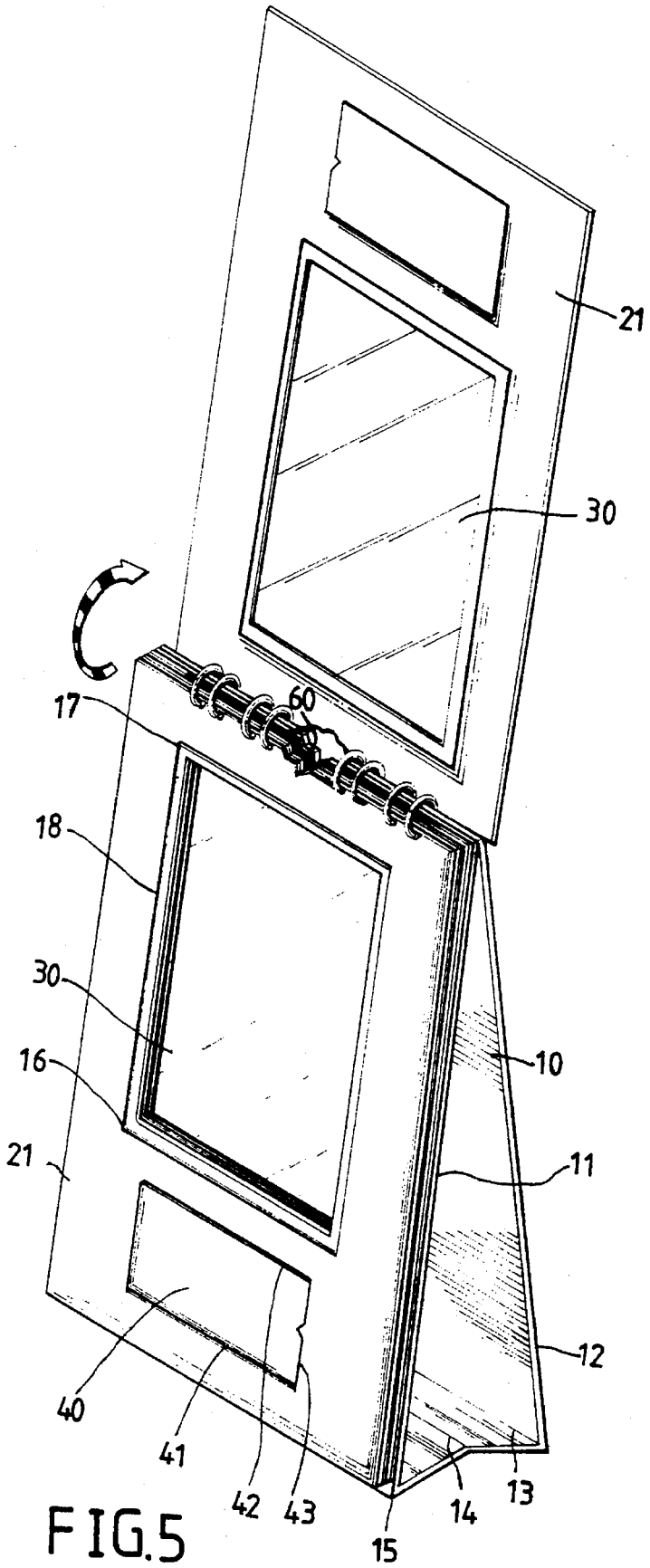
FIG. 5 is a schematic view illustrating the way that the loose-leaf picture album of the present invention is turned.
Figure 6:
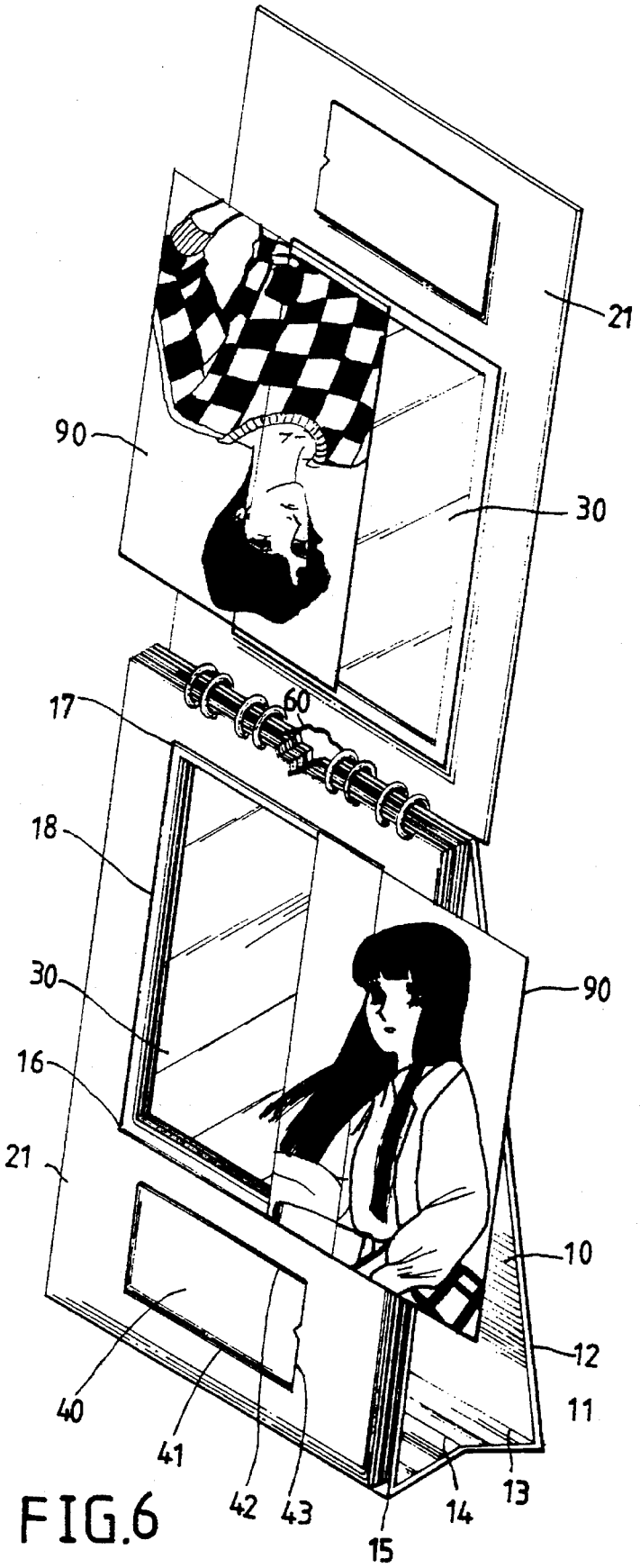
FIG. 6 is a schematic view illustrating the way that the front cover and the back cover of the loose-leaf picture album of the present invention are turned.

Each of the blank pages 20 is provided at the upper edge thereof with a plurality of perforations 200 by means of which each of the blank pages 20 is fastened movably to the upper edges of the front piece 11 and the rear piece by a coil fastener 50. The blank pages 20 can be therefore turned freely, as shown in FIGS. 5 and 6. An arcuate cross rod 60 is movably fitted into the coil fastener 50 such that the arcuate cross rod 60 can be concealed at such time when the loose-leaf picture album of the present invention is displayed uprightly on a desk top. The loose-leaf picture album of the present invention can be fastened to a wall by hooks, thanks to the arcuate cross rod 60.

Figure 3:
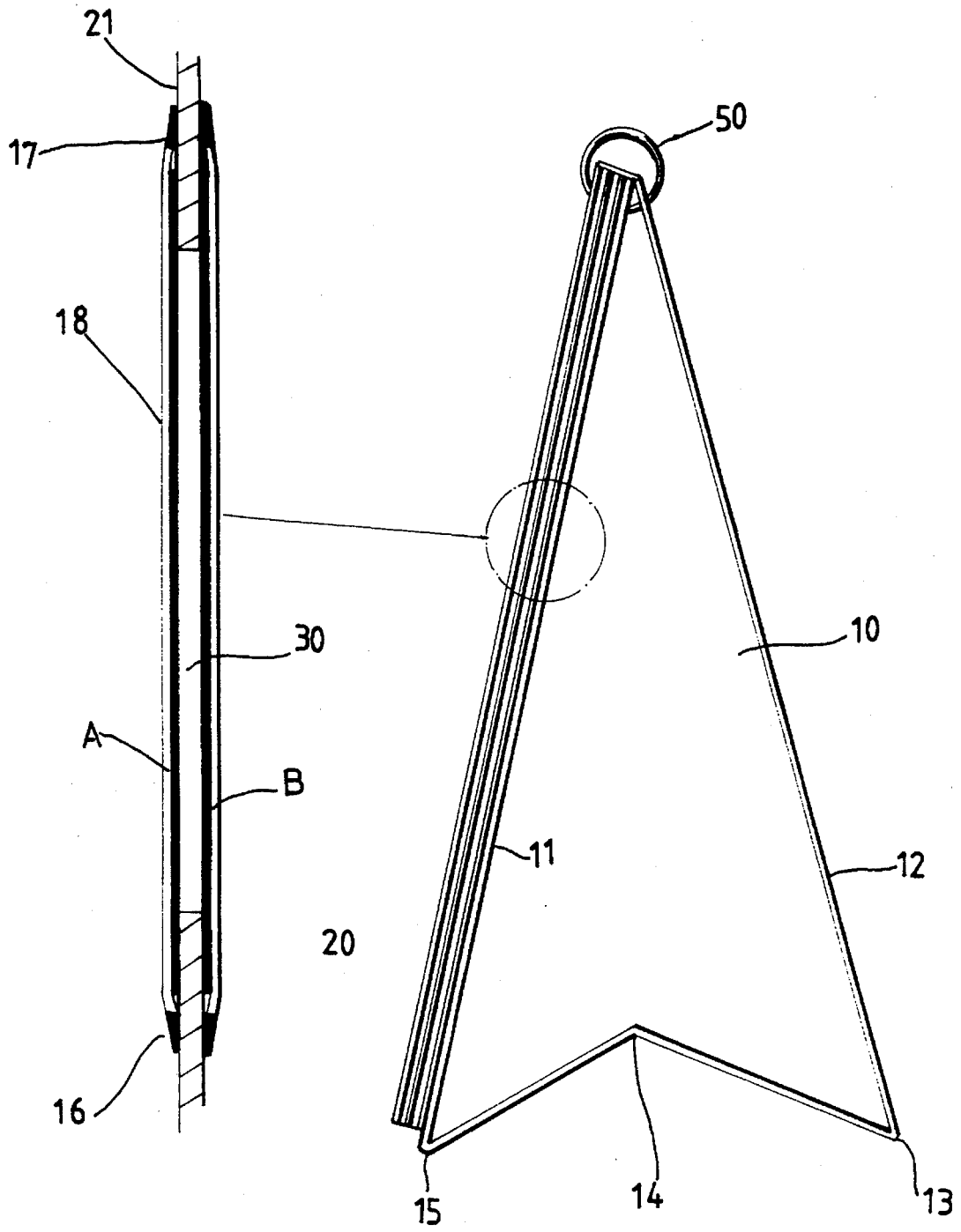
FIG. 3 is a sectional view of the present invention as shown in FIG. 1.
Figure 4:
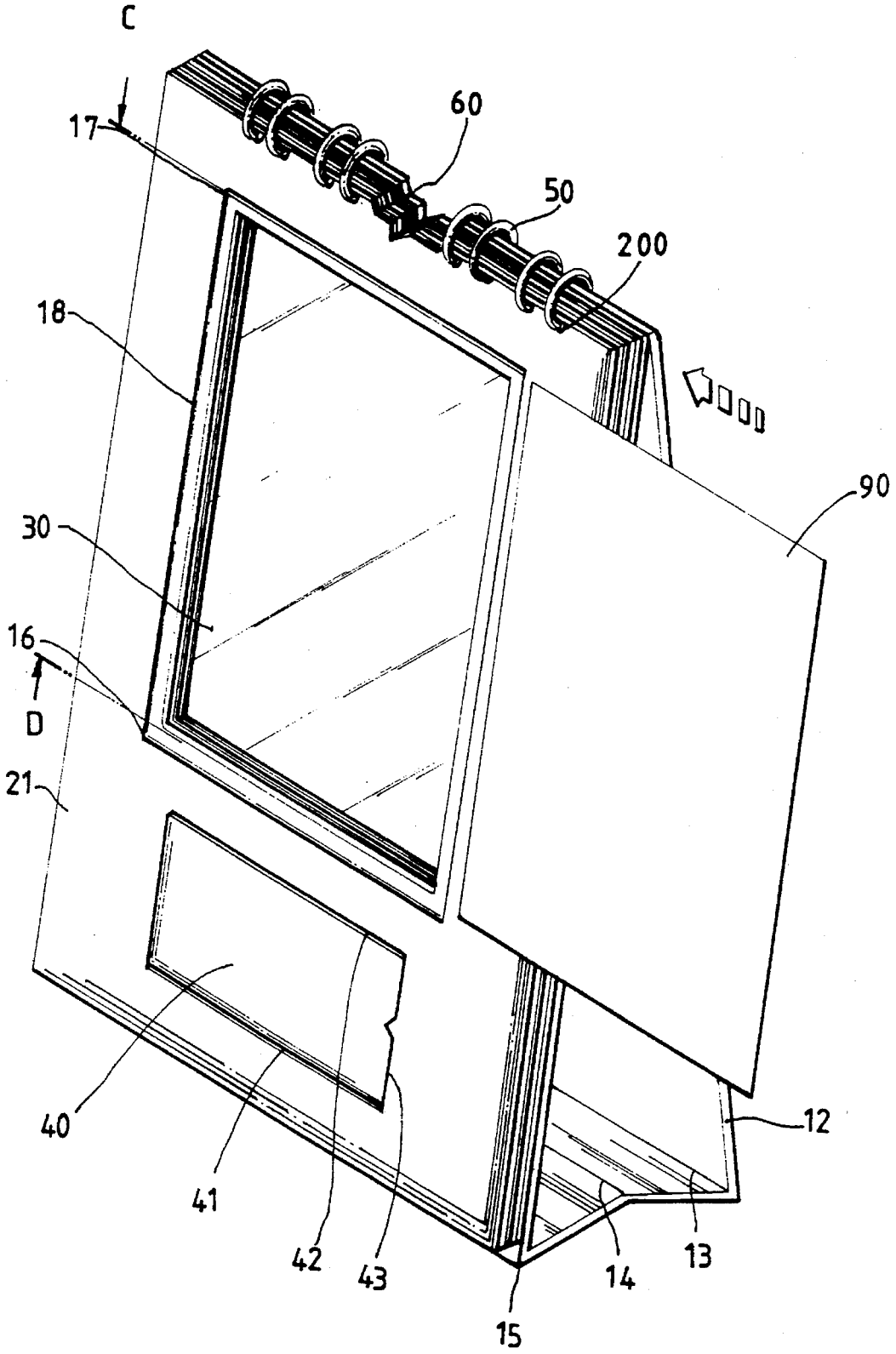
FIG. 4 is a schematic view illustrating the way that a picture is mounted in the loose-leaf picture album of the present invention.

As shown in FIG. 3, each of the blank pages 20 is provided respectively on the front surface and the back surface thereof with a transparent protective membrane 18. Located between the front and the rear protective membranes is an open spaces 18 and 21 through which a picture 90 can be inserted thereinto or removed therefrom.

The embodiment of the present invention described above is to be regarded in a 11 respects as merely illustrative and not restrictive. Accordingly, the present invention may be embodied in other specific forms without deviating from the spirit thereof. The present invention is therefore to be limited only by the scope of the following appended claims.

What is claimed is:

1. A loose-leaf picture album comprising:

a bottom plate including a front piece and a rear piece each having a lower portion and an upper portion, at least one connection piece coupled between said lower portion of said front piece and said rear piece so as to form an upright configuration and so as to be supported on a supporting surface, said connection piece including a plurliaty of creases formed therein, a coil fastener coupling said upper portions of said front piece and said rear piece together, a plurality of blank pages including an upper portion secured to said coil fastener so as to be secured to said bottom plate, said blank pages each including at least one picture window having a first tipper edge and a first lower edge and having at least one open side portion, said blank pages each including at least one information window having a second upper edge and a second lower edge and having at least one open side port, a plurality of first transparent protective membrane each including an upper portion and a lower portion secured to said first upper edges and said first lower edges of said picture window so as to allow insertion of a picture into said picture window via said open side portion, a plurality of second transparent protective membrane each including an upper portion and a lower portion secured to said second upper edges and said second lower edges of said information window so as to allow insertion of a card member into said information window via said open side port, and an arcuate cross rod engaged in said coil fastener for securing said loose-leaf picture album to a supporting member.

* * * * *